US005746519A

United States Patent [19]

Ricketts

[11] Patent Number: 5,746,519

[45] Date of Patent: May 5, 1998

[54] BI-DIRECTIONAL THERMAL PRINT HEAD ALIGNMENT APPARATUS AND METHOD

[75] Inventor: Kenneth W. Ricketts, Houston, Tex.

[73] Assignee: Oyo Instruments, Inc., Houston, Tex.

[21] Appl. No.: 643,666

[22] Filed: May 6, 1996

[51] Int. Cl.[6] ..... B41J 2/375

[52] U.S. Cl. ..... 400/120.01; 400/120.02

[58] Field of Search ..... 400/120.01, 120.02, 400/120.03, 120.04

[56] References Cited

U.S. PATENT DOCUMENTS

| | | | |
|---|---|---|---|
| Re. 35,026 | 8/1995 | Mahoney | 400/120.17 |
| 5,186,553 | 2/1993 | Sugiura et al. | 400/242 |
| 5,264,864 | 11/1993 | Hollman et al. | 346/1.1 |
| 5,360,276 | 11/1994 | Petermann | 400/55 |
| 5,474,394 | 12/1995 | Koike et al. | 400/120.04 |

FOREIGN PATENT DOCUMENTS 63-132065 6/1988 Japan .

*Primary Examiner*—Edgar S. Burr
*Assistant Examiner*—Daniel J. Colilla
*Attorney, Agent, or Firm*—Fulbright & Jaworski L.L.P.

[57] ABSTRACT

A print head alignment system, which includes: a) a printer having a moveable lid member and a stationary lower frame portion pivotally attached to the lid member; b) a platen having a core and a vertical center line, where the core is rotateably attached to the lower frame portion; c) a floating print head having an upper portion and a lower portion, the print head being pivotally attached to the lid member, where the print head is adapted to move in a vertical and horizontal plane; d) a nib line, which includes a row of a plurality of resistive printing elements, disposed along the print head lower portion; and e) a self-alignment assembly fixedly attached to the print head, where the assembly is adapted to contact and partially surround a portion of the platen core when the lid member is pivoted to come into contact with the lower frame portion; where when the lid member is in contact with the lower frame portion, the self-alignment assembly and the print head become positioned such that the nib line and the platen vertical center line coincide; and where the platen core includes at least one alignment groove formed thereon, each groove being adapted to receive a portion of the self-alignment assembly.

13 Claims, 2 Drawing Sheets

BI-DIRECTIONAL THERMAL PRINT HEAD ALIGNMENT APPARATUS AND METHOD

BACKGROUND OF THE INVENTION

1. Field of the Invention

This invention relates to an apparatus and method of aligning a thermal print head. More specifically, this invention relates to an apparatus and method of aligning a thermal print head for a thermal plotter.

2. Brief Description of the Related Technology

Thermal plotters currently in use include a thermal print head and a motor driven plotter platen which rotates in steps to cause the thermal medium to be printed upon to pass by the print head. The thermal print head typically includes a plurality of tiny resistors, or nibs (typically measuring approximately 0.0025 inches axially along the print head and 0.004 inches in a direction perpendicular to the axis of the print head), to which current is independently turned on or off by a print head controller device. The thermal medium is typically white paper or clear film, both of which have a thermally sensitive coating. An electric stepper motor coupled to the platen causes the platen to rotate and move the medium past the print head in small increments. At each step (increment) of medium movement past the printhead, current is caused to flow or not flow through each of the nibs. For 36 inch wide 400 dpi (dots per inch) printhead, there are approximately 14,400 nibs.

The nibs are typically aligned in a row configuration across the print head, such that the nib row is perpendicular to the direction of travel of the medium passing between the print head nibs and the platen. When current is applied to a nib, it heats up and turns black the area of the medium in proximity to the nib. Without current being applied, the area of the medium in proximity to the nib remains unchanged. The tiny nibs heat up and cool down very quickly to ensure clarity in printing, without smears.

Those in the graphic arts have recently determined that using thermal printers to make film masks for silk screen printing, or other high precision uses, can be less costly, more efficient and more environmentally friendly than the traditional photographic techniques currently used. No photographic developing chemicals need be used. The blank, or mask, for a particular silk screen print is made by passing thermal sensitive print medium through the thermal printer. This requires that the printer have greater printing precision and registration than the typical thermal printer used today for printing general text materials, or other present, non-high precision uses.

Thus, a need exists for a thermal printer, which includes a thermal print head, having a more precise alignment mechanism for aligning the print head over the thermal medium in a lateral and longitudinal (bi-directional) manner to achieve the desired resolution and accuracy necessary for the graphic arts and other high precision applications.

SUMMARY OF THE INVENTION

The present invention is for an apparatus and method of bi-directionally aligning a thermal print head for a thermal plotter to ensure the thermally sensitive medium passing between the print head and the printer platen will be more precisely aligned in a predictable and repeatable manner. To achieve the desired printer resolution and accuracy, the movement of the medium past the line of resistive nibs in the thermal print head must be very well controlled. A precision ground rubber platen is used to transport the medium, where the platen is driven by a precision stepping motor.

The thermally non-sensitive side of the medium is loaded over the platen and the thermal print head is then brought down and into contact with the thermally sensitive side of the medium, causing good friction contact between print head and the medium. The medium then moves in synchronism with the turning of the platen. Small errors introduced by tolerances of the platen diameter, or by other causes, are corrected by adjusting the time intervals between steps of the stepping motor.

To provide accurate and repeatable alignment of the print head to the platen, the print head is allowed to "float" relative to the hinged lid of the printer. Self-aligning guides attached to the print head come down and into contact with the platen core on at least one side of the platen material. This prevents the print head from moving laterally relative to the platen axis. Additionally, the aligning guides are adapted to fit into a groove machined into the platen core. This prevents longitudinal movement of the print head relative to the platen axis.

DETAILED DESCRIPTION OF THE PREFERRED EMBODIMENT

Figure 1:
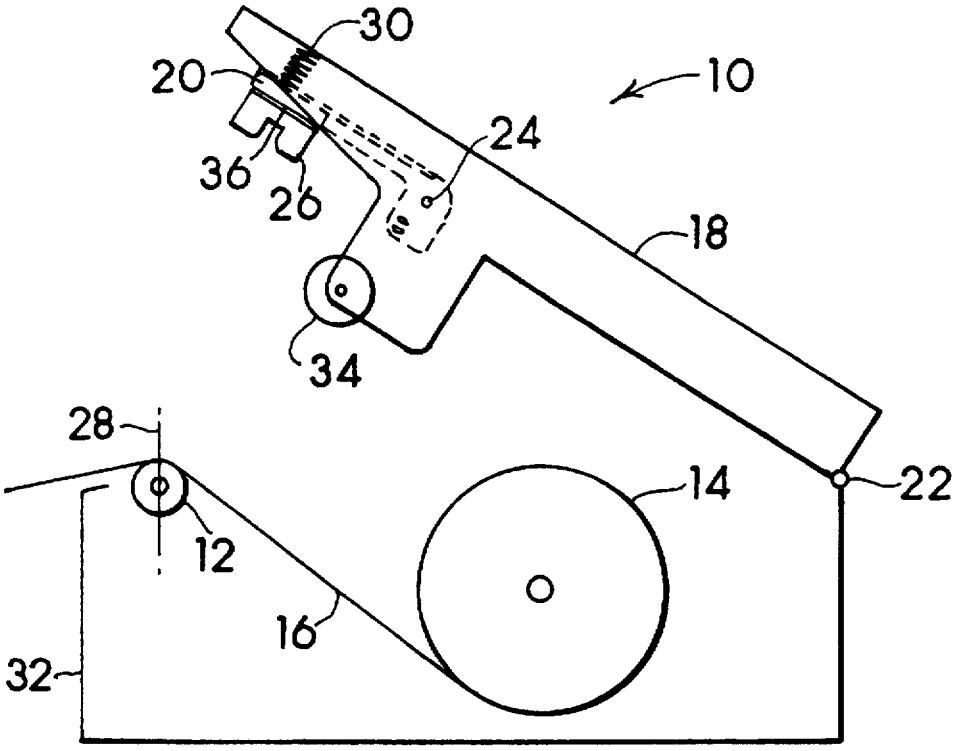
FIG. 1 is a schematic side view of the thermal printer of the present invention having the lid open.

FIG. 1 schematically depicts the arrangement of the major components of a thermal printer 10 relevant to the present invention. Printer head frame, or lid member, 18 is shown in an open position with respect to lower frame portion 32 of printer 10. Lid 18 is permanently connected to lower frame portion 32 by hinge 22, which allows lid 18 to pivot to an open and closed position with respect to lower frame portion 32.

Floating print head 20 has several degrees of freedom. It is allowed to pivot vertically around pivot point 24 of lid 18 and can move horizontally along the longitudinal axis 52 (FIG. 4) of platen 12. Pivot point 24 can be a hinge or other appropriate pivotable connection. Thermally sensitive medium 16 is stored on feeder roll 14. Medium 16 is stretched out and over the top of platen 12, as shown. Platen 12 is preferably a precision ground rubber coated steel core which is fixed to lower frame portion 32.

Figure 2:
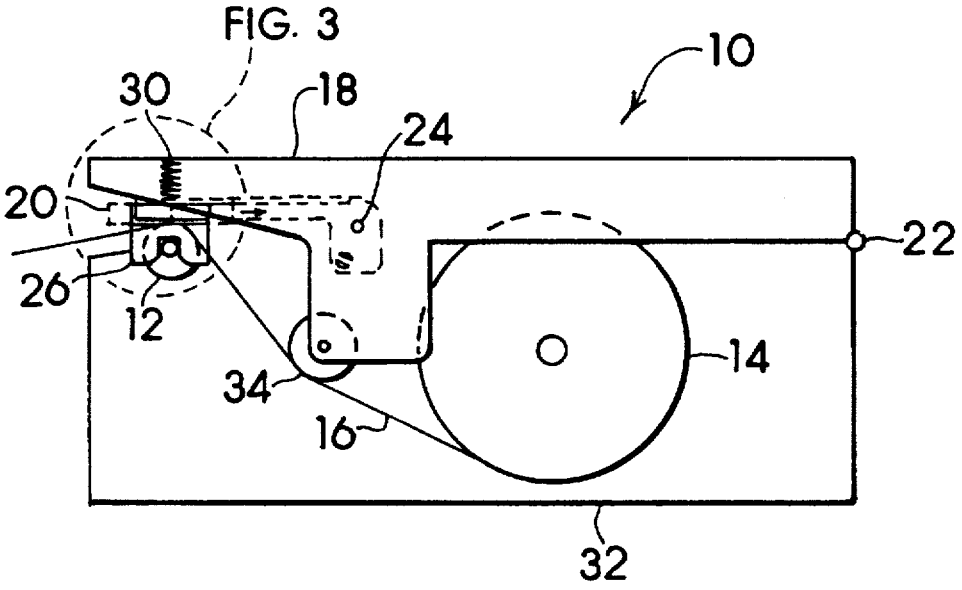
FIG. 2 is a schematic side view of the thermal printer of the present invention having the lid closed.

One end of each spring 30 is fixedly attached to lid 18 and the other spring end is attached to the upper portion of print head 20. Springs 30 provide a positive vertical spring bias on floating thermal print head 20 to ensure print head 20 comes into good friction contact with medium 16 when lid 18 is brought down and into contact with lower frame portion 32, as shown in FIG. 2. In this closed position, printer 10 includes idler 34 which is pressed down and into contact with medium 16, causing tension on the medium 16 to increase. This action facilitates better friction between medium 16 and platen 12, thus ensuring better quality printing and better control of medium 16 which is fed from roll 14, moving under idler 34, over platen 12 and under print head 20.

For accurate printing, the nib line 36 of print head 20 should align with center line 28 of platen 12 when lid 18 is closed. Nib line 36 is made up of a plurality of tiny resistive printing elements (not shown) known in the art. The printing elements are arranged substantially in a single row along the bottom portion of print head 20 parallel to the longitudinal axis 52 (FIG. 4) of platen 12.

To prevent movement of print head 20 during printing operation, self-guided alignment members 26, which are affixed to either end of print head 20, are used to fixedly hold print head 20 in position so nib line 36 is positioned precisely over platen 12 center line 28. For printing operation, this ensures accurate registration and printing of medium 16.

Figure 3:
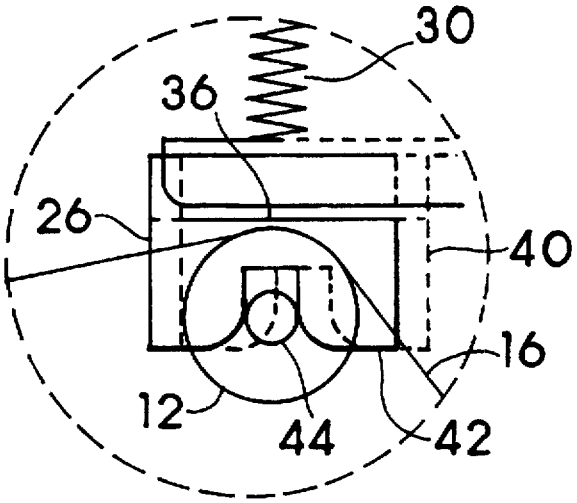
FIG. 3 is a schematic detailed view of the alignment of the thermal print head and the platen core of the present invention.

As shown in FIG. 3, as lid 18 is closed, alignment members 26 are adapted to position themselves around core 44 of platen 12. This locks print head 20 into position with respect to the longitudinal axis 52 (FIG. 4) of platen 12 such that movement of print head 20 perpendicular to axis 52 is prevented. FIG. 3 illustrates the original position 40 of print head 20 and the final self-aligned position 42 of print head 20.

Figure 4:
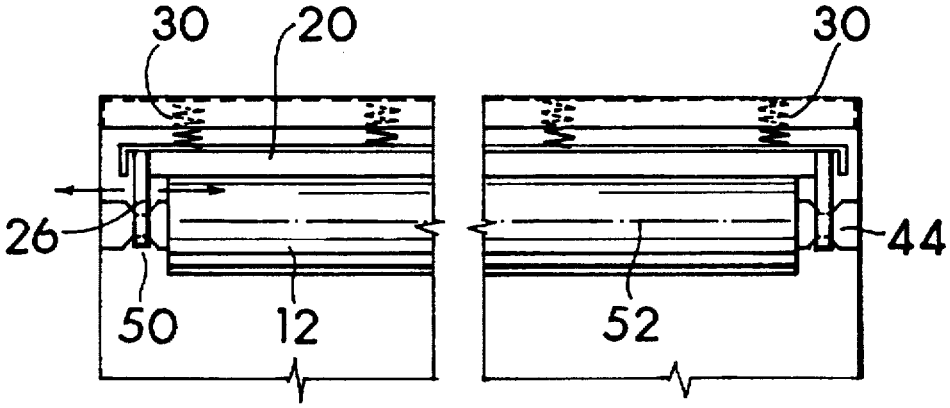
FIG. 4 is a partial front view of the arrangement of the alignment members for the thermal print head of the present invention.

FIG. 4 illustrates the position of alignment members 26 on either end of the core 44 of platen 12. Alignment members 26 are adapted to be received by alignment grooves, or notches, 50 in core 44. The grooves 50 are made by machining core 44, or by other appropriate methods known in the art. This alignment prevents floating print head 20 from having movement along the longitudinal axis 52 of platen 12.

The foregoing disclosure and description of the invention are illustrative and explanatory of the preferred embodiments, and changes in the components, circuit elements, or connections may be made without departing from the spirit of the invention.

What is claimed is:

1. A print head alignment system, comprising:

(a) a frame;

(b) a cylindrical rotatable platen having its ends mounted to said frame, said platen having an alignment groove formed thereon at a location adjacent so said frame, (c) a floating-print head, said floating-print head being moveable between a raised position and a lowered position; and (d) a first alignment member fixedly attached to said floating-print head, said alignment member being adapted to be received by the alignment groove of said platen, to fix the location of said floating-print head in the direction parallel with the longitudinal axis of said platen when said floating-print head is in the lowered position.

2. The print head alignment system of claim 1, further comprising:

a second alignment member fixedly attached to said floating-print head; wherein said first and second alignment members are adapted to contact said platen to fix location of said floating-print head in a direction orthogonal with the longitudinal axis of said platen.

3. The print head alignment system according to claim 2, wherein said first print head alignment member is located in the proximity to one end of said platen and said second print head alignment member is located in proximity to the other end of said platen.

4. The print head alignment system of claim 1, further comprising:

(a) a nib line, fixedly attached to said floating point head; and (b) a second alignment member fixedly attached to said floating-print head, wherein said first and second alignment members are adapted to contact said platen to fix location of said nib parallel to said longitudinal axis of said platen.

5. The print head alignment system according to claim 1, wherein said platen includes a precision ground rubber coating.

6. The print head alignment system according to claim 1, wherein said platen further comprises steel.

7. A print head alignment system, comprising:

(a) a frame;

(b) a lid member pivotally attached to said frame;

(c) a cylindrical platen rotatably mounted to said frame, said platen having an alignment groove formed thereon adjacent to said frame;

(d) a floating-print head, pivotally mounted to said lid member; and (e) a first alignment member fixedly attached to said floating-print head, said alignment member adapted to be received by the alignment groove formed on said platen to fix the location of said floating print head in the direction parallel with the longitudinal axis of said platen.

8. The print head alignment system according to claim 7, further comprising at least one spring fixedly attached to said lid member, wherein said spring presses said print head firmly against said platen.

9. Method for aligning a printer head, comprising of the steps:

(a) providing a frame;

(b) providing a cylindrical rotatable platen mounted to said frame and having at least one alignment groove formed thereon adjacent to said frame;

(c) providing a floating-print head, moveable between a raised position and a lowered position, said floating-print head having a first alignment member fixedly attached to said floating-print head, wherein said first alignment member is adapted to be received into the alignment groove of said platen;

(d) moving said floating-print head from the raised position to the lowered position; and (e) receiving the first alignment member into said alignment groove fixing the location of said floating-print head in the direction parallel to longitudinal axis line of said platen.

10. The method for aligning a printer head according to claim 9, wherein said platen includes a precision ground rubber coating.

11. The method for aligning a printer head according to claim 9, wherein said platen further comprises steel.

12. Method for aligning a printer head, comprising of the steps:

(a) providing a frame;

(b) providing a cylindrical rotatable platen mounted to said frame and having at least one alignment groove formed thereon adjacent to said frame;

(c) providing a floating-print head, moveable between a raised position and a lowered position, said floating-print head having a first and second alignment members fixedly attached to said floating-print head, wherein said first alignment member is adapted to be received into the alignment groove of said platen, and second alignment member is adapted to be received by said platen;

(d) moving said floating-print head from the raised position to the lowered position; and (e) receiving the first alignment member into said alignment groove fixing the location of said floating-print head in the direction parallel to longitudinal axis line of said platen, receiving said platen into said second alignment member said first and second alignment members fixing the location of said floating-print head in a direction orthogonal to the longitudinal axis of said platen.

13. The method for aligning a printer head according to claim 12 wherein said first print head alignment member is located in the proximity to one end of said platen and said second print head alignment members is located in proximity to the other end of said platen.

* * * * *